US008256952B2

(12) United States Patent
Loiseau

(10) Patent No.: US 8,256,952 B2
(45) Date of Patent: Sep. 4, 2012

(54) WRIST WATCH INCLUDING A REVERSIBILITY DEVICE

(76) Inventor: Dominique Loiseau, Montreux (CH)

( * ) Notice: Subject to any disclaimer, the term of this patent is extended or adjusted under 35 U.S.C. 154(b) by 77 days.

(21) Appl. No.: 12/675,986

(22) PCT Filed: Sep. 4, 2007

(86) PCT No.: PCT/IB2007/053552

§ 371 (c)(1),
(2), (4) Date: Mar. 12, 2010

(87) PCT Pub. No.: WO2009/030984

PCT Pub. Date: Mar. 12, 2009

(65) Prior Publication Data

US 2010/0302913 A1 Dec. 2, 2010

(51) Int. Cl.
*A44C 5/00* (2006.01)

(52) U.S. Cl. ..... 368/281; 368/277

(58) Field of Classification Search ..... 368/281, 368/277; 224/164, 167–168
See application file for complete search history.

(56) References Cited

U.S. PATENT DOCUMENTS 712,285 A * 10/1902 Gerald ..... 368/277
712,286 A * 10/1902 Gerald ..... 368/277
4,597,138 A * 7/1986 Hirsch ..... 24/265 B
2006/0018202 A1* 1/2006 Girardin et al. ..... 368/281
2006/0034161 A1* 2/2006 Muller ..... 368/281
2006/0126445 A1* 6/2006 Bouille ..... 368/281
2007/0274163 A1* 11/2007 Wild ..... 368/316
2008/0068933 A1* 3/2008 Chevalier et al. ..... 368/282
2009/0257323 A1* 10/2009 Soltani ..... 368/281

* cited by examiner

*Primary Examiner* — Sean Kayes
(74) *Attorney, Agent, or Firm* — Galbreath Law Offices, P.C.; John A. Galbreath

(57) ABSTRACT

The invention relates to a reversible watch housing (1) against which is provided on both sides a removable member (2, 2') including the horns (3) of said housing (1). Each member (2, 2') is connected to the watch housing (1) by attachment means arranged so that said member (2, 2') can be locked to the watch housing (1) respectively in a first and second stable position. The removable member (2, 2') can also be actuated for pivoting about its center by 180° along an axis perpendicular to the central axis of the watch housing (1) so as to move from one stable position to the other, each removable member (2, 2') includes a bearing side (4), said bearing side (4) being maintained against a portion (5) located on the periphery of the watch housing (1), by an elastic member (6) provided inside the middle of said housing (1) and connected to the removable member (2, 2') through an opening (7) located on the periphery of the watch housing (1). The opening (7) is formed so as to correspond with the rotation axis of the removable member (2, 2'). The removable member (2, 2') can be released from one or the other stable positions in order to allow its rotation by 180° along the axis perpendicular to the central axis of the watch housing (1), the elastic member (6) acting on the removable member (2, 2') in order to return the same into one or the other of its stable positions.

8 Claims, 3 Drawing Sheets

WRIST WATCH INCLUDING A REVERSIBILITY DEVICE

Figure 1:
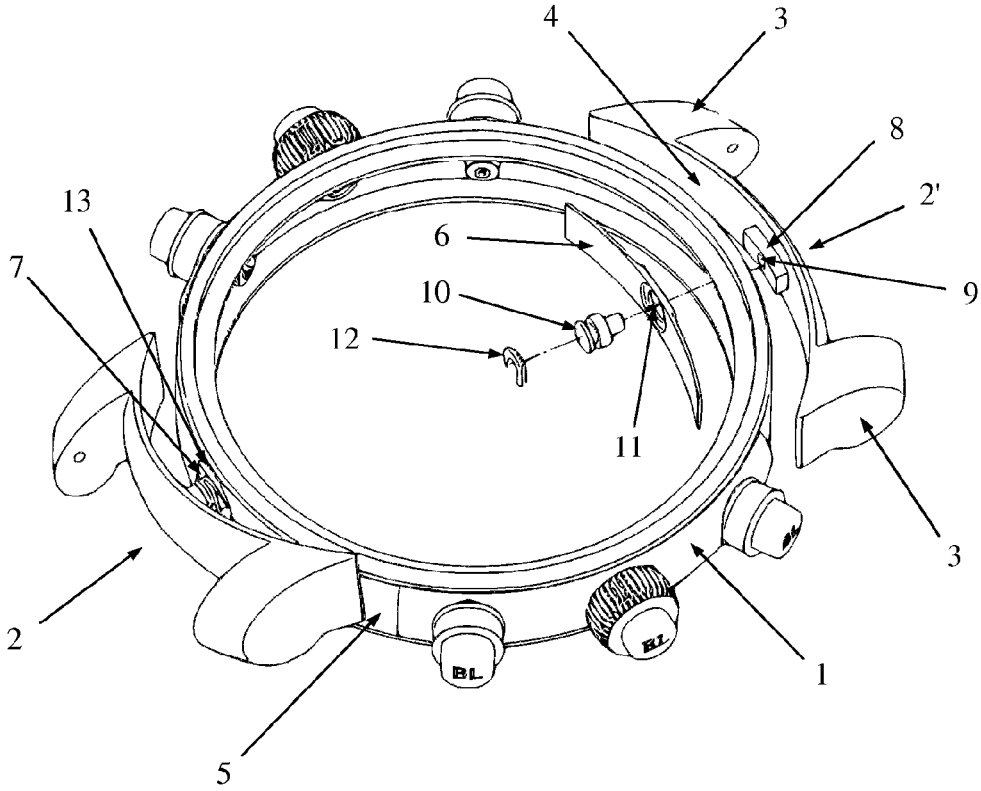

The present invention relates to horology, and more specifically a mechanism for reversing the watch case relative to a strap.

Countless devices allowing a watch case to be reversed with respect to a strap already exist in the prior art. Most of these devices are complicated and are detrimental to the styling of the watch.

Nonetheless, there are some watches that have a reversibility device in which the components of the mechanism do not interfere with the clean lines of the watch. One such mechanism is disclosed for example in publication CH659167. This describes a wristwatch with two different displays, one on each face, and which has a reversibility device comprising two removable elements on which the lugs of the watch are arranged. These removable elements are located either side of the watch case and can be actuated to pivot through 180° at their center about a journal on an axis perpendicular to the central axis of the watch case in order to orient either face of the watch according to the type of display the wearer of the watch wishes to show.

The watch case is locked relative to one of the ends of the strap by first and second balls arranged in first and second housings, respectively, one on either side of a rectangular part of the watch case. These balls are acted on by a return spring which tends to engage them in a hollow formed in the end of a rectangular loop in a position corresponding to the balls.

However, this form of locking creates a limitation in the geometrical shape of the watch case, since the latter has to have a rectangular part adjacent to each end of the watch strap.

Publication CH138929 discloses a wristwatch comprising two diametrically opposite pivots fixed so as to project out of the watch case, and on which the strap attachments pivot. These attachments possess a curvature in order to be able to conform to part of the circumference of the watch case. However, this device has the drawback of having no locking system, and the watch case is held in position by the wearer's wrist only.

The object of the present invention is to provide a wristwatch comprising an improved device for reversing the watch case with respect to the strap, which device is discrete and in perfect harmony with the styling of the watch.

In accordance with the invention, this object is achieved by means of a reversible watch case as claimed in claim 1 against which is located on either side a removable element possessing the lugs of said case. Each removable element is connected to the watch case by fixing means arranged in such a way that said element can be locked to the watch case in a first stable position and a second stable position. The removable element is also actuatable to pivot at its center through 180° about an axis perpendicular to the central axis of the watch case in order to move from one of the stable positions to the other. Each removable element comprises a contact side, this contact side being held against a part situated on the perimeter of the watch case by an elastic member arranged inside the middle of said case and connected to the removable element through an opening situated in the perimeter of the watch case. The opening is arranged in line with the axis of rotation of the removable element, the removable element being disengageable from either of its stable positions in order to allow its rotation through 180° about the axis perpendicular to the central axis of the watch case, and the elastic member acting on the removable element in order to return it to either of its stable positions.

Figure 2:
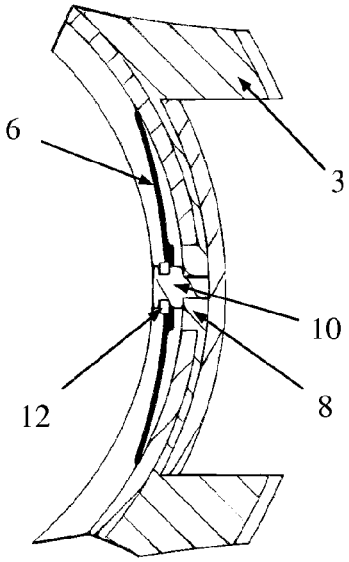
Figure 3:
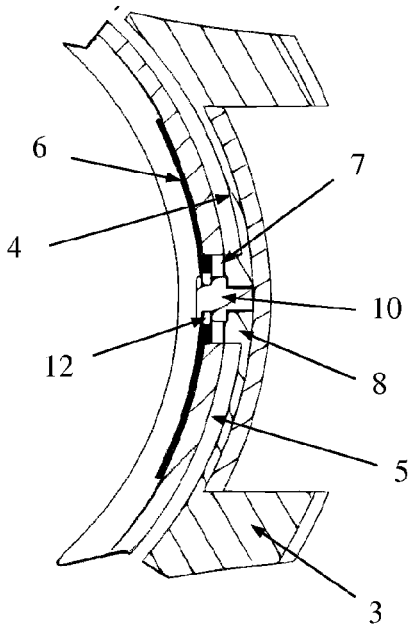
Figure 4:
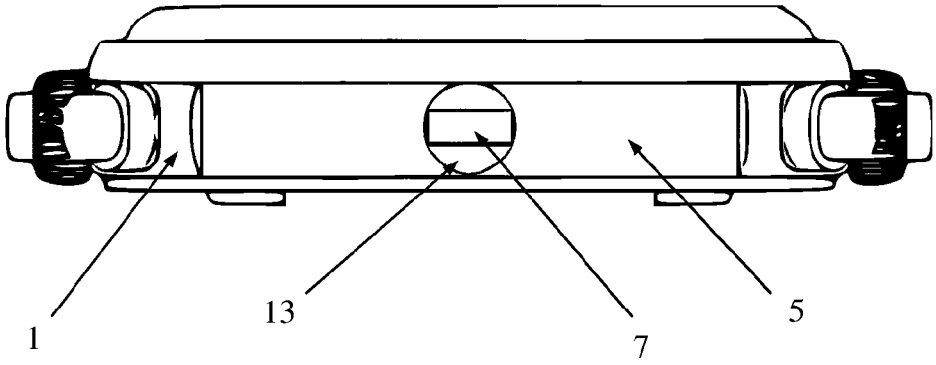
Figure 5:
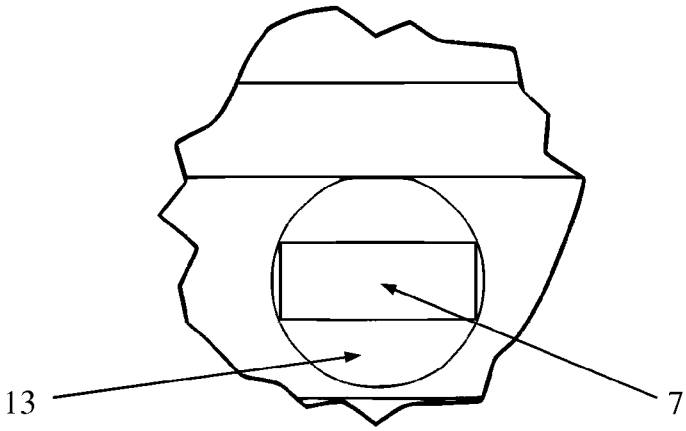
Figure 6:
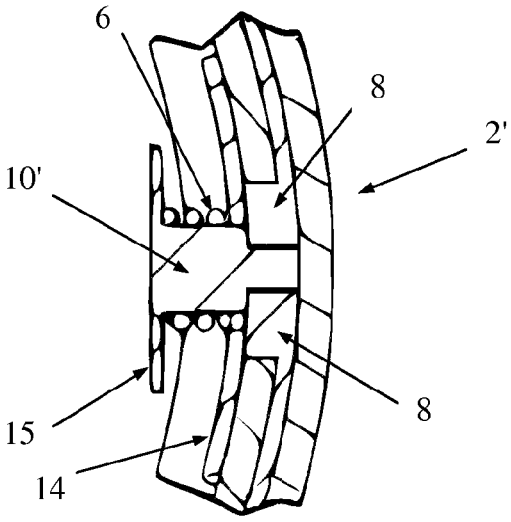
Figure 7:
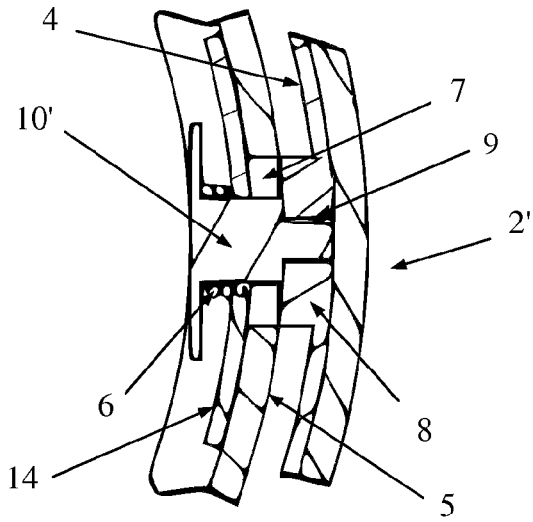

The features of the invention will become more clearly apparent on reading a description of a number of embodiments offered purely by way of example, no limitation being implied. The description refers to the diagrammatic figures in which:

FIG. 1 is an exploded perspective view of the watch case and of the reversibility device in a first embodiment, FIG. 2 is a partial cross section through one of the removable elements connected, by the reversibility device, to the watch case, when said device is locked, FIG. 3 is a partial cross section through the removable element seen in FIG. 2 when the latter is in the disengaged position to allow it to begin to be rotated with respect to the watch case, FIG. 4 is a side view of the watch case without the removable element, FIG. 5 is a detailed view of FIG. 4, FIG. 6 is a partial cross section through one of the removable elements, in a second embodiment, when the reversibility device is locked, FIG. 7 is a partial cross section through the removable element seen in FIG. 6 when the latter is in the disengaged position to allow it to begin to be rotated with respect to the watch case.

In a first embodiment of the present invention (FIG. 1), the wristwatch comprises a watch case (1) and two removable elements (2, 2') on which the lugs (3) of the watch are arranged.

Each removable element (2, 2') is connected to the watch case (1) by fixing means, the technical features of which will be described later, and which are arranged in such a way that said element (2, 2') can be locked to the watch case (1) in a first stable position and a second stable position. The removable element (2, 2') is furthermore actuatable to pivot at its center through 180° about an axis perpendicular to the central axis of the watch case (1) in order to move from one of the stable positions to the other.

The watch case (1) possesses on its outer circumference two diametrically opposite parts (5) which are ground so that the radius of curvature of each part (5) is slightly shorter than the radius of curvature of the outer circumference of the watch case (1). Each removable element (2, 2') possesses a concave side (4) identical to the radius of curvature of each ground part (5) so that it can be arranged to exactly fit the perimeter of said part (5). The thickness of the removable element (2, 2') is chosen in such a way that the element can blend into the outer circumference of the watch case (1) when these removable elements (2, 2') are locked in stable positions.

The removable element (2, 2') is locked against the ground part (5) of the watch case (1) via a flexible leaf (6) arranged inside the middle of said case (1) (FIGS. 2 and 3). The ends of this leaf (6) bear against the inner circumference of the watch case (1).

Two elongate openings (7) (FIGS. 4 and 5) are arranged in the center of each ground part (5) in positions corresponding to the axis of rotation of the removable element (2, 2'). Each opening (7) is designed to take an elongate nub (8) connected to the removable element (2, 2'), this nub (8) being situated in the center of the concave side (4) of each removable element (2, 2') and having an internal thread (9) in its center, in which a stud (10) for the cylindrical pivoting is screwed. The flexible leaf (6) has a bore (11) in its center, in which the pivot stud (10) is first arranged and then secured by a key (12).

The ends of the leaf (6) apply a certain stress to the inner circumference of the watch case (1) at their points of contact when the nub (8) is arranged inside the opening (7) so that the removable element (2, 2') is held firmly against the part (5) of the watch case (1).

To reverse the watch case (1), the removable element (2, 2') is pivoted through 180° about an axis perpendicular to the central axis of said case (1). This is made possible when the end of the strap connected to the removable element (2, 2') is pulled in order to bend the leaf spring (6) and disengage the nub (8) from the opening (7). The removable element (2, 2') can then be rotated about an axis perpendicular to the central axis of the watch case (1). In the course of this rotation, the surface of the nub (8) of the removable element (2, 2') is in permanent contact with a circular-shaped flat (13) situated around the opening (7). After a 180° rotation, the nub (8) is back in a position corresponding to the opening (7) and, because of the action of the leaf spring (6), fits once again inside the opening (7). The removable element (2, 2') is thus locked once again to the watch case (1).

In a second embodiment, the leaf spring (6) is replaced by a helical compression spring (6) (FIGS. 6 and 7). This spring (6) is arranged around the circumference of the central part of the pivot stud (10'). In this second embodiment, one of the ends of this stud (10') has a circular base (15) against which the compression spring (6) presses, while the other end of the stud (10') is ground and threaded so that it can be screwed into the internal thread (9) of the nub (8) of the removable element (2, 2'). The helical compression spring (6) is held in place by a retaining plate (14) arranged against part of the inner periphery of the watch case (1).

Operation of the reversibility system is identical to the first embodiment. The helical spring (6) is compressed by the circular base (15) when the end of the strap connected to the removable element (2, 2') is pulled in order to disengage the nub (8) from the opening (7). Rotating the removable element (2, 2') through 180° from the first stable position to the second is done exactly as in the first embodiment.

It goes without saying that the invention is not limited to the embodiments described above by way of examples but rather that it encompasses all variants. For example, the shape of the reversible watch case (1) can be oval or rectangular.

The invention claimed is:

1. A reversible watch case (1) against which is located on either side two removable elements (2, 2') possessing lugs (3) of said case (1), each element (2, 2') being connected to the watch case (1) by fixing means arranged in such a way that said element (2, 2') can be locked to the watch case (1) in a first stable position and a second stable position, the removable element (2, 2') also being actuatable to pivot at the removable element's center through 180.degree. about an axis perpendicular to a central axis of the watch case (1) in order to move from one of the stable positions to the other, which watch case is characterized in that each removable element (2, 2') comprises a contact side (4), this contact side (4) being held against a part (5) situated on a perimeter of the watch case (1) by an elastic member (6) arranged inside the middle of said case (1) and connected to the removable element (2, 2') through an opening (7) situated in the perimeter of the watch case (1), the opening (7) being arranged in line with the axis of rotation of the removable element (2, 2'), the removable element (2, 2') being disengageable from either of the removable element's stable positions in order to allow its rotation through 180.degree. about the axis perpendicular to the central axis of the watch case (1), and the elastic member (6) acting on the removable element (2, 2') in order to return to either of the stable positions.

2. The reversible watch case (1) as claimed in claim 1, characterized in that on the one hand the perimeter of the watch case (1) is circular, and on the other hand the contact side (4) of the removable element (2, 2') and the part (5) situated on the perimeter of the watch case (1) are concave and convex, respectively.

3. The reversible watch case (1) as claimed in claim 2, characterized in that the radius of curvature of the convex part (5) of the reversible watch case (1) is approximately equal to the radius of curvature of the concave contact side (4) of the removable element (2, 2'), and less than the radius of curvature of the external circumference of the watch case (1) in order to compensate for the thickness of the removable element (2, 2') so as to create an exactly circular watch case (1) when the removable elements (2, 2') are arranged in either of the stable positions against the two convex parts (5) of the watch case (1).

4. The reversible watch case (1) as claimed in claim 3, characterized in that a nub (8) is arranged in the center of the concave side (4) of each removable element (2, 2'), the nub (8) being held in the opening (7), which acts as a housing, by the elastic member (6) in order to lock the removable element (2, 2') in either of the stable positions.

5. The reversible watch case (1) as claimed in claim 4, characterized in that the opening (7) and the nub (8) are elongate.

6. The reversible watch case (1) as claimed in claim 1, characterized in that the elastic member (6) is a flexible leaf, and the ends of said leaf (6) bear against the inside edge of the watch case (1).

7. The reversible watch case (1) as claimed in claim 1, characterized in that the elastic member (6) is a helical compression spring.

8. A watch strap comprising the reversible watch case (1) as claimed in any one of the preceding claims, characterized in that the ends of the strap are attached to the removable elements (2, 2').

* * * * *